US005773406A

United States Patent [19]

Gross

[11] Patent Number: 5,773,406

[45] Date of Patent: Jun. 30, 1998

[54] FOAMING COMPOSITION

[75] Inventor: Stephen F. Gross, Souderton, Pa.

[73] Assignee: Henkel Corporation, Plymouth Meeting, Pa.

[21] Appl. No.: 791,972

[22] Filed: Jan. 31, 1997

Related U.S. Application Data

[63] Continuation of Ser. No. 503,745, Jul. 18, 1995, abandoned.

[51] Int. Cl.[6] ..... C11D 1/74; C11D 1/83

[52] U.S. Cl. ..... 510/426; 510/427; 510/470; 510/127

[58] Field of Search ..... 510/426, 427, 510/470, 127

[56] References Cited

U.S. PATENT DOCUMENTS

| | | | |
|---|---|---|---|
| 4,536,317 | 8/1985 | Cook et al. | 252/174 |
| 4,536,318 | 8/1985 | Cook et al. | 252/174.17 |
| 4,565,647 | 1/1986 | Llenado | 252/354 |
| 5,258,142 | 11/1993 | Giesen et al. | 252/552 |
| 5,266,690 | 11/1993 | McCurry, Jr, et al. | 536/18 |

FOREIGN PATENT DOCUMENTS

| | | |
|---|---|---|
| 0070074 | 7/1982 | European Pat. Off. . |
| 0070074 | 1/1983 | European Pat. Off. . |
| 0105556 | 9/1983 | European Pat. Off. . |
| 0105556 | 4/1984 | European Pat. Off. . |

OTHER PUBLICATIONS

Sharma, et al., "Correlation Of Chain Length Compatibility And Surface Properties Of Mixed Foaming Agents With Fluid Displacement Efficiency and Effective Air Mobility In Porous Media", Ind. Eng. Chem. Fundam., 1984, vol. 23, pp. 213–220.

*Primary Examiner*—Paul Lieberman
*Assistant Examiner*—Necholus Ogden
*Attorney, Agent, or Firm*—Ernest G. Szoke; Wayne C. Jaeschke; Steven J. Trzaska

[57] ABSTRACT

A foaming composition having enhanced levels of foaming and foam stability consisting essentially of (a) an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (b) a fatty alcohol sulfate having the general formula II:

$$R_3OSO_3M \qquad \text{II}$$

wherein $R_3$ is an alkyl group containing from 10 to 11 carbon atoms, and M is selected from the group consisting of alkali metals, alkaline earth metals and mixtures thereof, in a wt-% actives ratio of components (a) and (b) of from about 1:10 to about 10:1, respectively.

11 Claims, No Drawings

FOAMING COMPOSITION

This application is a continuation of application Ser. No. 08/503,745 filed on Jul. 18, 1995 now abandoned.

FIELD OF THE INVENTION

The present invention generally relates to a foaming surfactant composition. More particularly, by mixing an alkyl polyglycoside with a fatty alcohol sulfate having an average chain-length distribution of from 10 to 11 carbon atoms, a synergism is observed which results in the formation of a surfactant composition having enhanced levels of foamability and foam stability.

BACKGROUND OF THE INVENTION

It is known that various surfactants have been found to be useful in cleaning compositions, such as shower gels, shampoos, and light duty detergents such as dish washing detergents. In these types of compositions, good foamability is a prerequisite. The most widely used surfactants in these types of compositions are anionic surfactants such as alkyl sulfates, alkyl ether sulfates, sulfonates, sulfosuccinates and sarcosinates.

Although the use of anionic surfactants in these compositions permits the attainment of desirable properties, including good foamability, the degree of foaming and its stability is oftentimes still insufficient. Foam stability relates to the ability of the foam, once formed, to remain intact for extended periods of time, thus enhancing the cleaning performance of the surfactant compositions.

It is sometimes advantageous to use mixtures of surfactants in cleaning compositions wherein the surfactants can serve different functions, e.g., one serving to improve foamability and another serving to adjust viscosity. However, known surfactant mixtures typically provide a compromise when compared to the specific characteristics of the individual surfactants if used by themselves. For example, a mixture of more costly surfactants such as amine oxides, betaines and alkanolamides which provide good foamability by themselves, with less expensive surfactants which provide poorer foamability, will result in the formulation of a surfactant composiiton having an intermediate degree of foamability and poor foam stability.

Alkyl polyglycosides containing long-chain alkyl groups are known nonionic surfactants. Moreover, as was noted above, the expert knows that surfactant mixtures generally show synergistic effects and often have detergent properties better than the sum total of the values of the individual components.

Detergents containing alkyl glycosides in combination with at least one typical anionic surfactant are described in European patent application EP 070 074. In addition, liquid detergents containing alkyl polyglycosides, certain other nonionic surfactants and anionic surfactants are also known from European patent application EP 105 556.

While mixtures of alkyl glycosides and anionic surfactants oftentimes result in the formation of a surfactant composition which produces adequate amounts of stable foam, even higher levels of more stable foam are desirable for many applications.

It is therefore an object of the present invention to provide a surfactant composition having enhanced levels of foamability and foam stability.

SUMMARY OF THE INVENTION

The present invention relates to a foaming composition having enhanced levels of foamability and foam stability containing (a) an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (b) a fatty alcohol sulfate having the general formula II:

$$R_3OSO_3M \qquad \text{II}$$

wherein $R_3$ is an alkyl group containing from 10 to 11 carbon atoms, and M is selected from the group consisting of alkali metals, alkaline earth metals and mixtures thereof, in a wt-% actives ratio of components (a): (b) of from about 10:1 to about 1:10.

The present invention also provides a process for formulating the above-disclosed foaming composition involving mixing components (a) and (b) in the disclosed wt-% actives ratio.

DESCRIPTION OF THE INVENTION

Other than in the operating examples, or where otherwise indicated, all numbers expressing quantities of ingredients or reaction conditions used herein are to be understood as being modified in all instances by the term "about".

Preferred alkyl polyglycosides suitable for use in the present invention have the general formula I:

$$R_1O(R_2O)_b(Z)_a \qquad \text{I}$$

wherein Z is a glucose residue and b is zero. Such alkyl polyglycosides are commercially available, for example, as GLUCOPON®, or PLANTAREN® surfactants from Henkel Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.55.
3. GLUCOPON® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.5.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The fatty alcohol sulfates suitable for use in the present invention have the general formula II:

$$R_3OSO_3M \qquad \text{II}$$

wherein $R_3$ is an alkyl group containing from 10 to 11 carbon atoms, and M is selected from the group consisting of alkali metals, alkaline earth metals and mixtures thereof. The fatty alcohol sulfates may be prepared in known manner by reaction of the corresponding alcohol component with a typical sulfating agent, more particularly sulfur trioxide or chlorosulfonic acid, and subsequent neutralization, preferably with alkali bases, ammonium bases or alkyl- or hydroxyalkyl-substituted ammonium bases. In a particularly preferred embodiment of the present invention, the fatty alcohol sulfate is prepared by mixing sodium lauryl sulfate having 12 carbon atoms as its primary carbon chain, with sodium n-decyl sulfate having 10 carbon atoms as its primary carbon chain in a wt-% actives ratio of from 5:1 to 1:5, and preferably about 1: 1, respectively.

According to the present invention, a foaming composition having significantly enhanced levels of both foamability and foam stability can be formulated by mixing alkyl polyglycosides with the above-disclosed fatty alcohol sulfate, in a wt-% actives ratio of alkyl polyglycoside to fatty alcohol sulfate of from about 10:1 to about 1:10, respectively.

A particularly preferred alkyl polyglycoside is of the type in general formula I wherein $R_1$ is a monovalent organic radical having from 8 to 16 carbon atoms; Z is a saccharide residue having 5 or 6 carbon atoms; b is zero and a is a number having a value of 1.55. Thus, in a particularly preferred embodiment of the present invention,a surfactant composition having significantly enhanced levels of both foamability and foam stability can be formulated by mixing the preferred alkyl polyglycoside with a fatty alcohol sulfate having an average carbon chain length distribution of 10 to 11 carbon atoms, in a wt-% actives ratio of alkyl polyglycoside to fatty alcohol sulfate of about 1:1.

This invention provides a foaming composition and process for formulation wherein the foaming composition exhibits significantly enhanced levels of foaming and foam stability. Once formulated, the surfactant composition may be employed in a variety of in-use compositions where both high foaming and high foam stability are desired such as, for example, in cleaning compositions or agricultural foam markers.

The present invention will be better understood from the examples which follow, all of which are intended to be illustrative only and not meant to unduly limit the scope of the invention. Unless otherwise indicated, percentages are on a weight-by-weight basis.

EXAMPLES

Various surfactant compositions were tested to determine the amount of foam they produced and its stability. Their composition and the results obtained are listed in Table 1 below.

TABLE 1

| | A | B | C | A:B, 1:1 actives blend | A:C, 1:1 actives blend | A:B:C, 2:1:1 actives blend |
|---|---|---|---|---|---|---|
| foam height (ml) | 365 | 325 | 355 | 415 | 425 | 450 |
| clear layer height (ml) @ 3.5 min. | 110 | 115 | 105 | 95 | 92 | 83 |

A = GLUCOPON ® 425
B = STANDAPOL ® WAQ-LC (a sodium lauryl sulfate product of Henkel Corp.)
C = SULFOTEX ® 110 (a sodium n-decyl sulfate product of Henkel Corp.)

The foam height generated by the various surfactant compositions was measured per the following method. 150 grams of a 0.05% active solution of each of the examples was prepared using deionized water. The temperature of each solution was then adjusted to about 30° C. Each solution was then agitated for approximately ten seconds in a Waring Blender at high, constant speed. Each agitated solution was then immediately poured into a 500 ml graduated cylinder. The initial foam height of each solution was then measured, the results of which are noted in Table 1 above.

The clear layer results are a measure of foam stability after a period of about 3.5 minutes. This test involves measuring the clear layer appearing beneath the foam in the graduated cylinder, approximately 3.5 minutes after initial foam height has been determined. Lower clear layer height values indicate higher foam stability.

As can be seen from the results obtained in Table 1, by mixing an alkyl polyglycoside with a fatty alcohol sulfate having an average carbon chain distribution of between 10 and 11 carbon atoms, both the amount of foam produced and its stability are significantly enhanced.

What is claimed is:

1. A foaming composition having enhanced levels of foaming and foam stability consisting essentially of:

(a) an alkyl polyglycoside having the general formula I:

$$R_1O(R_2O)_b(Z)_a \quad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, and (b) a fatty alcohol sulfate consisting of a mixture of a lauryl sulfate and a n-decyl sulfate in a wt-% actives ratio of from 5:1 to 1:5, wherein components (a) and (b) are combined in a wt-% actives ratio of from about 1:10 to about 10:1.

2. The composition of claim 1 wherein in formula I $R_1$ is a monovalent organic radical having from 8 to 16 carbon atoms; b is zero; and a is a number having a value of 1.55.

3. The composition of claim 1 wherein said fatty alcohol sulfate is derived from a mixture of sodium lauryl sulfate and sodium n-decyl sulfate in a wt-% actives ratio of about 1:1.

4. The composition of claim 1 wherein said wt-% actives ratio of components (a): (b) is about 1:1.

5. The composition of claim 2 wherein said wt-% actives ratio of components (a): (b) is about 1:1.

6. A process for formulating a surfactant composition having enhanced levels of foaming and foam stability comprising mixing:

(a) an alkyl polyglycoside having the general formula I:

$$R_1O(R_2O)_b(Z)_a \quad \text{I}$$

10 wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, with (b) a fatty alcohol sulfate consisting of a mixture of a lauryl sulfate and a n-decyl sulfate in a wt-% actives ratio of from 5:1 to 1:5, wherein components (a) and (b) are combined in a wt-% actives ratio of from about 1:10 to about 10:1.

7. The process of claim 6 wherein in formula I $R_1$ is a monovalent organic radical having from 8 to 16 carbon atoms; b is zero; and a is a number having a value of 1.55.

8. The process of claim 6 wherein said fatty alcohol sulfate is derived from a mixture of sodium lauryl sulfate and sodium n-decyl sulfate in a wt-% actives ratio of about 1:1.

9. The process of claim 6 wherein said wt-% actives ratio of components (a): (b) is about 1:1.

10. The process of claim 7 wherein said wt-% actives ratio of components (a):

(b) is about 1:1.

11. A foaming composition having enhanced levels of foaming and foam stability consisting essentially of:

(a) an alkyl polyglycoside having the general formula III:

$$R_4O(Z)_a \quad \text{III}$$

wherein $R_4$ is a monovalent organic radical having from 8 to 16 carbon atoms; Z is a saccharide residue having 5 or 6 carbon atoms; a is a number having a value of 1.55, with (b) a fatty alcohol sulfate consisting of a mixture of sodium lauryl sulfate and sodium n-decyl sulfate in a wt-% actives ratio of components (a): (b) of about 1:1.

* * * * *